US005208826A

United States Patent [19]

Kelly

[11] Patent Number: 5,208,826

[45] Date of Patent: May 4, 1993

[54] AIMABLE LASER MODULE MOUNT

[75] Inventor: Robert Kelly, Grants Pass, Oreg.

[73] Assignee: Applied Laser Systems, Grants Pass, Oreg.

[21] Appl. No.: 817,391

[22] Filed: Jan. 6, 1992

[51] Int. Cl.[5] ..... H01S 3/08

[52] U.S. Cl. ..... 372/107; 248/176

[58] Field of Search ..... 248/274, 276, 913, 176, 248/180; 385/90, 91; 372/107, 108, 109

[56] References Cited

U.S. PATENT DOCUMENTS 4,916,713 4/1990 Gerber ..... 372/107

4,958,794 9/1990 Brewer ..... 248/183

*Primary Examiner*—John D. Lee

*Assistant Examiner*—John Ngo

*Attorney, Agent, or Firm*—Stoel Rives Boley Jones & Grey

[57] ABSTRACT

A laser device is mounted on the front surface of a trigger guard on a firearm such that a laser beam is emitted in the direction of fire. Mounting screws pass through the trigger guard into an end of the laser device, and a pivot device placed between the laser device and trigger guard permits adjustment of the orientation of the laser beam relative to the barrel axis of the firearm. Power to the laser device is provided by passing wires through channels that are drilled through the trigger guard, and then to a battery through a momentary switch that is mounted on the front surface of the firearm handle or grip.

20 Claims, 3 Drawing Sheets

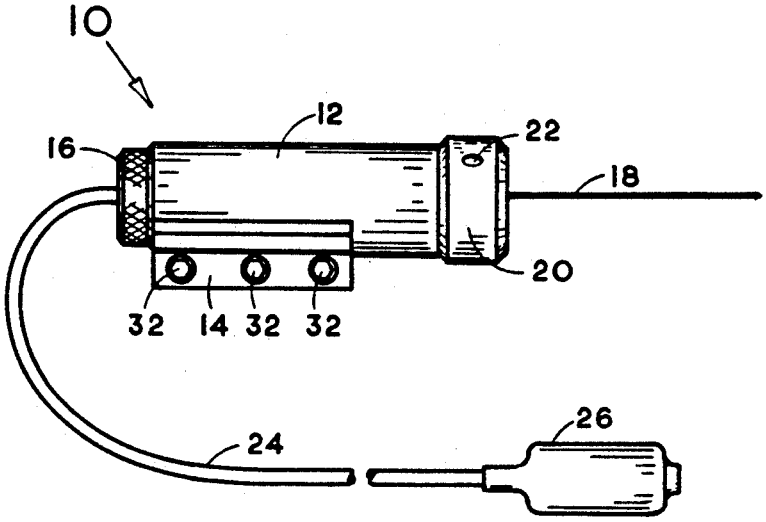
FIG. 1 PRIOR ART
FIG. 2
PRIOR ART
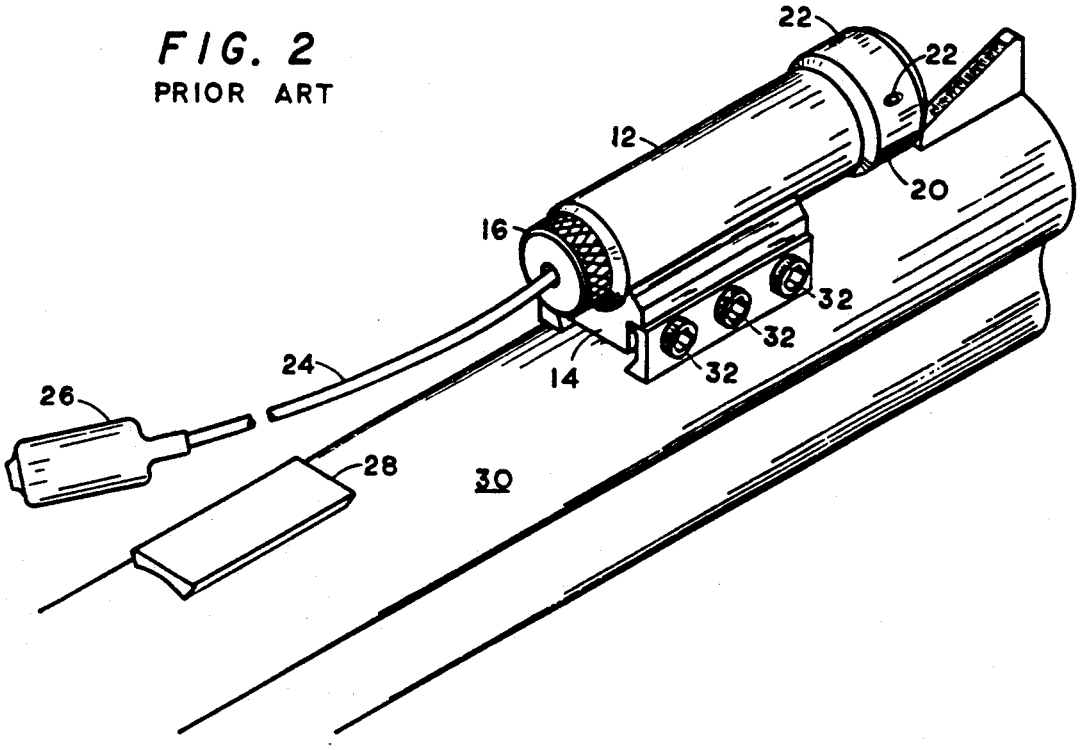

AIMABLE LASER MODULE MOUNT

RELATED APPLICATIONS

This application relates to allowed patent application Ser. No. 524,152 filed May 16, 1990, now U.S. Pat. No. 5,121,188, to allowed patent application Ser. No. 659,494 filed Feb. 21, 1991, now U.S. Pat. No. 5,111,476, and to patent application Ser. No. 817,737 filed Jan. 7, 1992, still pending, all of which are assigned to the assignee of the present invention.

FIELD OF THE INVENTION

This invention relates to devices that employ semiconductor lasers to emit visible or infrared radiation and are mounted on firearms for aiming purposes.

BACKGROUND OF THE INVENTION

Since its advent, the small and rugged semiconductor laser has found extensive use in applications that had been met only unsatisfactorily, or not at all, by the relatively bulky and more fragile Helium-Neon gas laser. Among these applications has been that of providing an aiming point in connection with the use of firearms: the laser diode and required drive circuitry and battery source are mounted on the firearm, and the direction of the laser beam is adjusted so that at some predetermined range, the dot of light produced by the laser beam is coincident at the point at which a bullet from a standard round of ammunition will impact when fired. The advantage of such an aiming system is that the operator need not look through any sights at all: if the laser beam has been appropriately aligned, a bullet will strike a target at the point identified by the laser dot, regardless of the manner in which the operator of the firearm may have been obliged to fire the weapon. For example, the operator may hold the weapon at arm's length, e.g., extending above some protective "cover," and view the target from a different vantage point than the location of the weapon itself, thereby avoiding exposure to any hostile fire from the targeted area. In addition, if a laser diode is used that emits infrared radiation, and if the operator is using night vision equipment that can "see" that infrared radiation, such laser aiming can occur without being detected by persons in the target area who do not also have night vision equipment.

One of the difficulties in achieving such a system, however, has been that of providing a stable and convenient mounting of the laser device to the firearm, and one that at the same time can be adjusted so that the laser dot will indeed coincide with the point of impact of a fired bullet at some preselected range. Secondly, since the module that contains the laser diode and drive circuitry, such as the "visible laser module" ("VLM TM") made by Applied Laser Systems, must be provided with a power source and a switch by which to control that power, it has been necessary to include external wires running to some type of switch that can be operated in conjunction with the trigger operation. Up to the present, the practice has been to provide a type of mounting structure within which the laser device can be mounted and adjusted in terms of orientation, and then to place that structure with its included laser module onto the firearm. A pair of leads runs from this structure to a momentary switch that is placed at a convenient point on the firearm. Aiming of the laser so that the beam spot coincides with the point of bullet impact at some desired range is then carried out by actual field tests.

Such a prior art structure is shown in FIG. 1, in which laser aimer 10 comprises a hollow laser body 12 and laser mount 14. The laser device itself (not shown) and a battery that powers the laser (also not shown) are contained within laser body 12. A knurled, screw-on cap 16 at an end of the laser body opposite the direction of laser beam 18 permits insertion of the battery. Laser body 12 includes, at the end from which laser beam 18 emerges, a portion 20 that has been expanded to accommodate the length of three alignment set screws 22 (of which just one is shown in FIG. 1) oriented at appropriate relative angles, with the inner ends of screws 22 touching an outer surface of the laser device. The inner diameter of laser body 12 is made sufficiently larger than the outer diameter of the laser device that by adjustment of the depth of penetration of screws 22 into laser body 12, the orientation of the laser device and hence of laser beam 18 relative to the longitudinal axis of laser body 12 can be adjusted. One disadvantage of this prior art system is that because of the close proximity of laser body 12 to the barrel on which it is to installed, at least one of screws 22 will be difficult to access. FIG. 1 also shows leads 24 which extend from screw-on cap 16 to momentary switch 26 for operation of power to the laser.

Several types of firearms, particularly rifles, include along the top surface thereof a .22 dovetail groove mount 28, for mounting a telescopic sight, as shown on the top surface of barrel 30 in FIG. 2. The cross-sectional structure of laser mount 14, shown in the isometric view of FIG. 2, is structured to slide onto groove mount 28, and upon being placed thereon laser mount 14 can be tightened onto groove mount 28 using mounting screws 32 that pass through laser mount 14. Once the laser device has been attached to the firearm in this manner, the orientation of laser beam 18 relative to the axis of the firearm itself (i.e., of the barrel) can be adjusted using set screws 22. For firearms that include groove mounts of different sizes than the .22 groove mount, such as the Weaver telescope mount, to avoid fabricating laser mount 14 in such various sizes an additional mounting adapter sized to adapt laser mount 14 to such a groove mount may be used. If the firearm has no groove mount at all, one must use some type of clamp, such as a "quick clamp," to attach the laser device to the firearm.

The principle disadvantage of such systems, especially when employed with a handgun such as a pistol or revolver, is the resultant bulk and awkward configuration. Handguns in particular are used most effectively, e.g., for law enforcement purposes, when they can be holstered. Standard holsters will not accommodate a firearm onto which a laser aimer has been mounted in the manner described (i.e., above the barrel), nor would such a firearm provide the usual level of convenience and utility even if a holster were fabricated for it. Also, lead wires that are external to the firearm can interfere with holstering of the weapon, and are also subject to wear or breakage. What is required and would be useful, therefore, is a method and apparatus for mounting a laser aimer onto a firearm that would eliminate such bulk and awkward configuration. It would also be useful to provide means for adjusting the orientation of the laser beam, and for turning on the laser beam, that are more integral to the firearm itself.

SUMMARY OF THE INVENTION

The invention comprises a method and apparatus for mounting a semiconductor laser module onto the front portion of a handgun, underneath the barrel, and just forward of the trigger guard. An additional aspect of the invention incorporates means for providing power to the laser in which external exposure of the wiring is minimized. Specifically, for any handgun for which the trigger guard is constructed of materials other than solid metal, e.g., the "plastic" type manufactured by Glock, the invention provides means for passing the lead wires necessary to operate the power control switch through the trigger guard so as to reach a convenient point on the handle. In another aspect of the invention, means for orientation of the laser beam are provided in which the laser device is adjusted by pressure against the trigger guard of the weapon itself.

Of course, the object to which the laser module is so mounted need not be a triggerguard, or even a firearm. For industrial control purposes, for example, the module can be mounted onto any convenient bracket that will accommodate the through holes and mounting screws described hereinafter, in precisely the same manner as onto a firearm.

The foregoing as well as other features and advantages of the invention will become more readily apparent from the following detailed description of a preferred embodiment of the invention, which proceeds with reference to the accompanying drawings.

BRIEF DESCRIPTION OF THE DRAWINGS

FIG. 1 depicts a prior art method of placing a laser device into a mount for mounting onto a firearm.

FIG. 2 shows an isometric view of the device of FIG. 1 as is conventionally mounted onto the barrel of a handgun.

DETAILED DESCRIPTION

Figure 3:
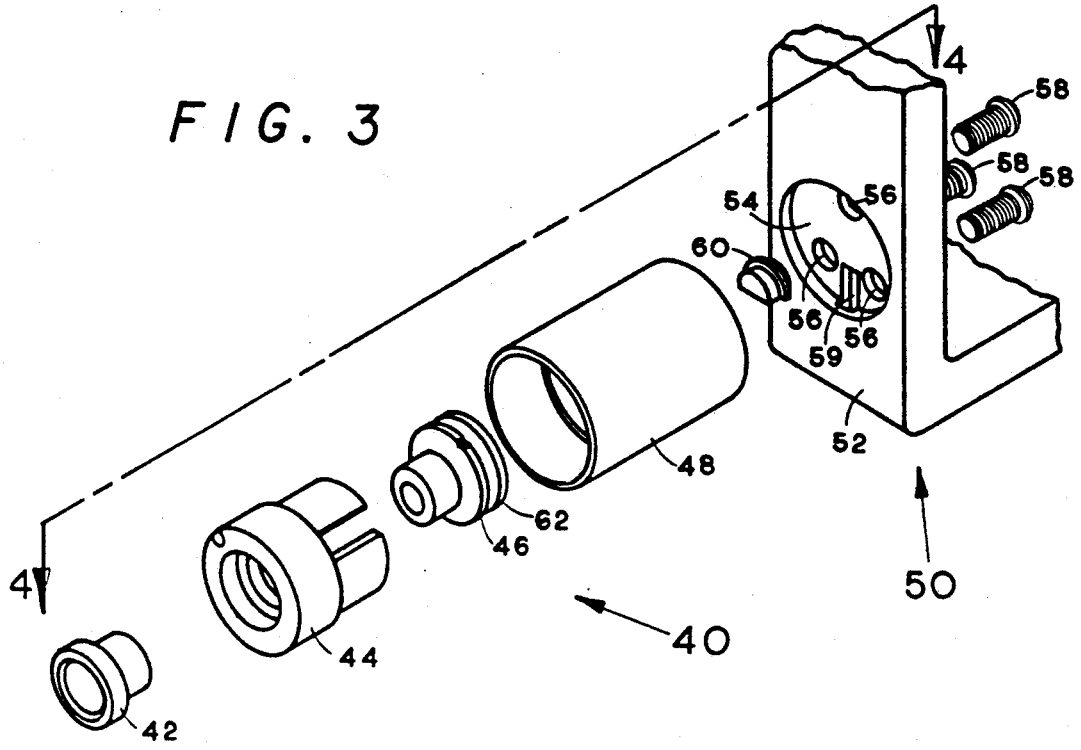
FIG. 3 shows an exploded, isometric view of apparatus for mounting a laser module onto the trigger guard of a handgun.

FIG. 3 depicts generally a laser device 40 comprising a lens 42, a heat sink 44, a laser diode 46, and laser body 48. The structure and method of manufacture of laser device 40 are described in detail in allowed patent application Ser. No. 659,494, filed Feb. 21, 1991, now U.S. Pat. No. 5,111,476 which text is hereby incorporated herein by this reference. Also shown in FIG. 3 is trigger guard 50, which represents an existing, standard trigger guard on a firearm such as a Glock automatic pistol. The method of the invention involves a procedure for modifying such a trigger guard to accommodate laser device 40.

Specifically, forward surface 52 of trigger guard 50 is machined out to form cavity 54 of a size to accommodate the outer surface of laser body 48 to a convenient depth. Also, at least three through holes 56 are drilled through the remaining material of trigger guard 50 within the area encompassed by cavity 54. Screws 58 then pass through the through holes 56. FIG. 3 also shows slot 59 and pivot 60, the function of which will be described below.

Figure 4:
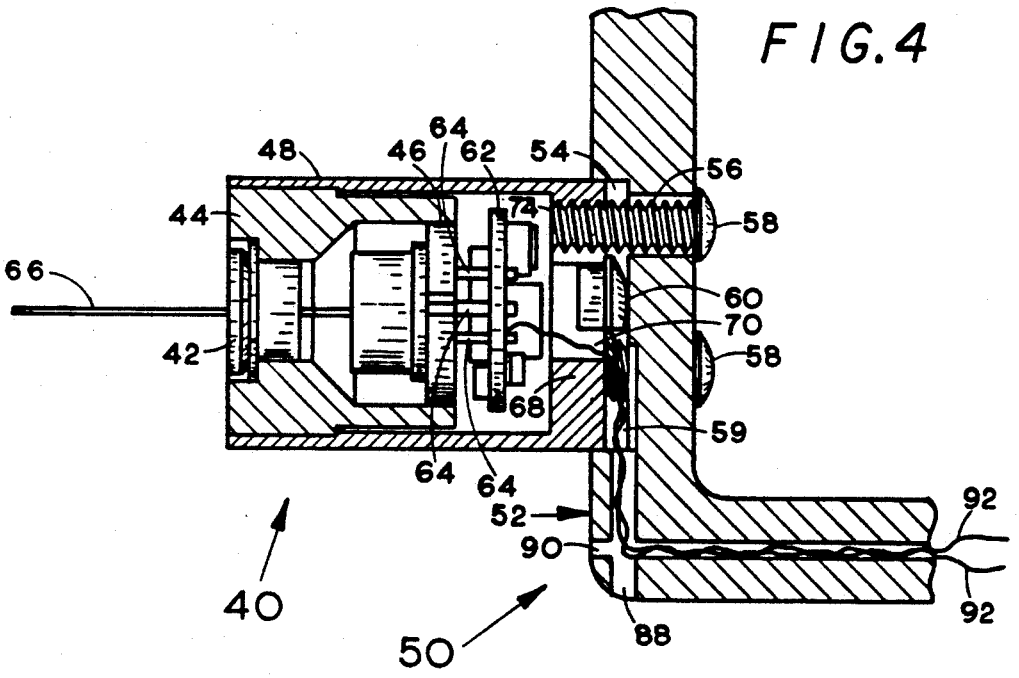
FIG. 4 shows a cross-section of the device of FIG. 3 taken through the line 4—4'.

A cross-sectional, enlarged and assembled view of the device of FIG. 3 is shown in FIG. 4. Specifically, lens 42 is shown as being installed within one end of heat sink 44, within the opposite end of which laser diode 46 is also installed. That composite structure, which is described in patent application Ser. No. 659,494 filed Feb. 21, 1991 now U.S. Pat. No. 5,111,476 as comprising an "aligned laser optic system" ("ALOS"), is installed as a unit within laser body 48. Additionally, FIG. 4 shows printed circuit board (PCB) 62, which provides appropriate currents for the operation of laser diode 46, connected through prongs 64 to an end of laser diode 46 that is opposite the direction of laser beam 66. Laser body 48 includes a ring-shaped inner extension 68 that is concentric with the axis of laser body 48, includes a hollow portion 70 that is likewise concentric with the axis of laser body 48, and has a back surface 72 that includes taps 74 (of which only one is shown in FIG. 4) that are sized to accommodate screws 58.

Figure 5:
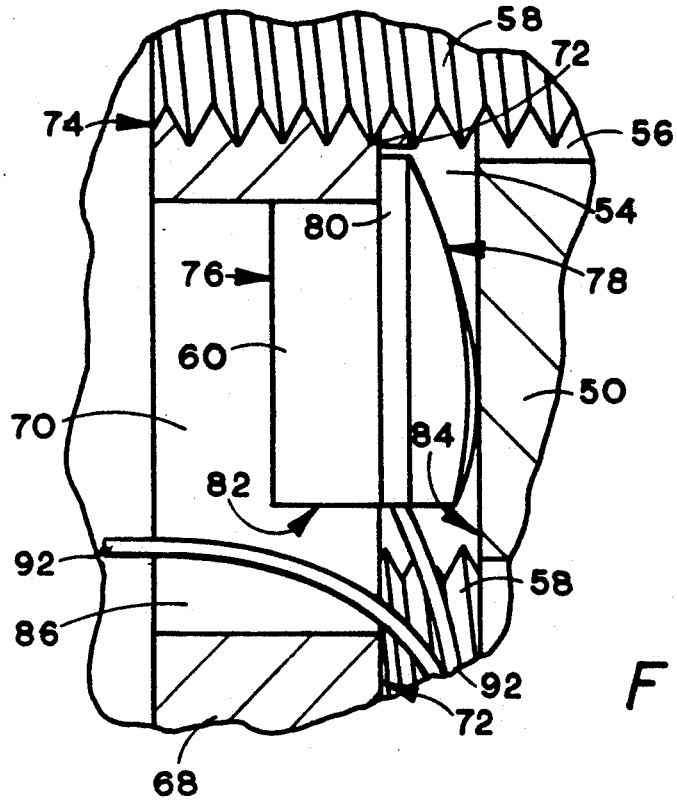
FIG. 5 shows an enlarged view of a portion of FIG. 4 that depicts the operation of the laser aiming system.

FIG. 5 discloses the function of pivot 60. This device is generally cylindrical in shape and contains a flat surface 76 and an opposite half-oval surface 78 from which rim 80 extends outwardly. In addition, a portion of the pivot has been removed at right angles to flat surface 76 and half-oval surface 78 to yield a flat end 82. In operation, pivot 60 is placed such that rim 80 contacts back surface 72 of extension 68, while half-oval surface 78 contacts surface 84 within cavity 54 of trigger guard 50. The construction of the laser module (i.e., the "ALOS" comprising lens 42, heat sink 44, and laser diode 46 as disclosed in patent application Ser. No. 659,494 filed Feb. 21, 1991, now U.S. Pat. No. 5,111,476, and PCB 62 as contained within laser body 48 as disclosed in patent application Ser. No. 817,737 filed Jan. 7, 1992) is such that the direction of laser beam 66 is made to coincide with the central axis of laser body 48, hence variation in the orientation of laser body 48 causes a similar variation in the direction of laser beam 66. Insertion of screws 58 through through holes 56 and then into taps 74 serves to mount the laser module onto trigger guard 50, and because of the half-oval shape of surface 78 on pivot 60, adjustment of the relative depth of penetration of screws 58 into taps 74 serves to vary the orientation of laser body 48 and hence the direction in which laser beam 66 is propagated. By such adjustment of screws 58, in other words, once the laser module is mounted onto trigger guard 50, for aiming purposes the "aim point" of laser beam 66 (i.e., the spot produced by laser beam 66 on a target) can be made to coincide with the point at which, at some predetermined distance, a bullet emerging from barrel 30 will impact.

The purpose in forming flat end 82 of pivot 60 is to permit passage of the wiring from PCB 62 through space 70, slot 59 and thence out to a switching device. That is, a first channel 88 is drilled through trigger guard 50 in a "vertical" direction (as shown in FIG. 4) so as to create slot 59 which encounters gap 86 that lies between back surface 72 of extension 68 and surface 84 within cavity 54 of trigger guard 50, and second channel 90 is drilled in a "horizontal" direction so as to pass at one point through first channel 88. Wires 92 that provide electrical power to PCB 62 pass through first and second channels 88, 90, through gap 86, and through space 70 so as to be accessible to PCB 62.

Figure 6:
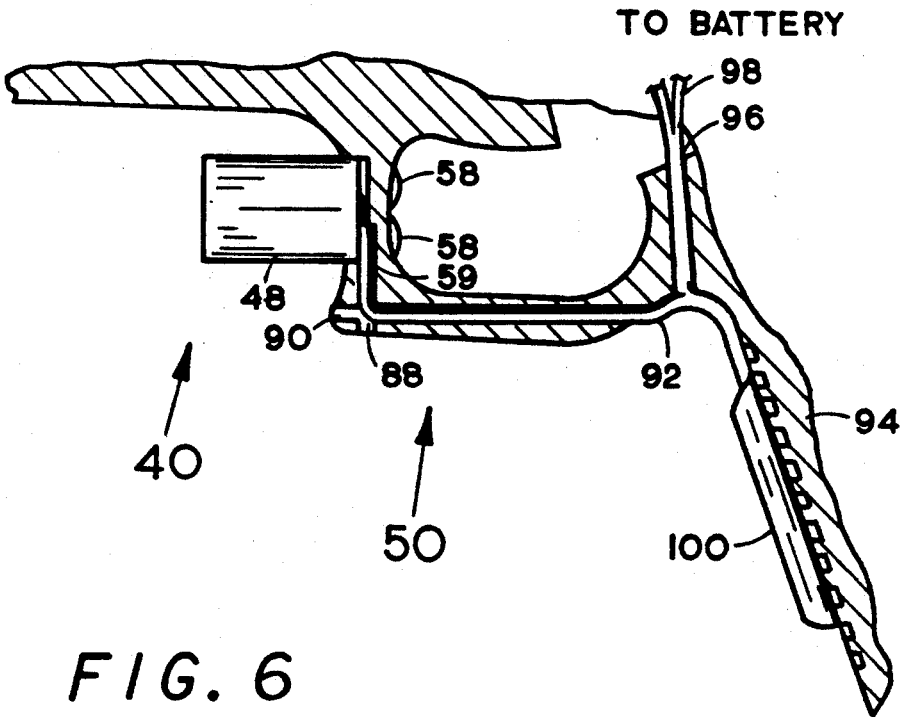
FIG. 6 shows the wiring to a laser module and a battery passing through the trigger guard of a firearm.

The structure of FIG. 5 as it relates to the remainder of the firearm in shown in FIG. 6, which shows laser device 40, laser body 48 and trigger guard 50 in a general manner, as well as channels 88, 90 and wires 92. In addition, FIG. 6 shows the extension of wires 92 out of second channel 90 along the surface of gun handle 94 and also a third channel 96 drilled through a rearward portion of trigger guard 50 to accommodate one of wires 92 and a second wire 98 to access a battery (not shown). The other one of wires 92, and wire 98, connect to momentary switch 100 mounted on gun handle 94. Depression of momentary switch 100 completes the circuit from the battery through wire 98 and thence to laser device 40 through one of wires 92, while the other wire 92 runs directly from laser device 40 through channels 88, 90 and 96 to the battery. Switch 100 can be depressed by a combination of the remaining fingers while the first ("trigger") finger is left free to operate the trigger. I an application in which a simple bracket is used instead of a trigger guard to mount a laser module, it may not be necessary to pass wires 92 or 98 through several channels, but only through one such channel through the bracket to the side thereof opposite laser device 40.

Having described and illustrated the principles of the invention in a preferred embodiment thereof, it will be readily apparent to those of ordinary skill in the art that the invention can be modified in arrangement and detail without departing from such principles. Consequently, I claim all modifications and variations coming within the spirit and scope of the invention as set forth in the following claims, and in all equivalents thereof.

I claim:

1. A device for mounting a laser device that emits a laser beam from one end thereof onto a bracket, comprising:

a bracket containing at least three through holes passing therethrough, an end portion of said laser device opposite the end from which said laser beam is emitted and having screw holes therein facing each of said through holes, a quantity of screws equal in number to said number of screw holes, said screws passing through said through holes and rotatably entering into said screw holes, means for varying the orientation of said laser device as the depth of entry of said screws into said screw holes is adjusted, and means for providing electrical power to said laser device.

2. The device of claim 1 wherein said means for varying the orientation of said laser device comprise a pivot device located between said bracket and said end portion of said laser device.

3. The device of claim 2 wherein said pivot device includes a half-oval surface facing against a surface of said bracket, and a rim extending outwardly therefrom that faces against said end portion, wherein said half-oval surface is caused to rotate against said surface of said bracket as the depth of entry of said screws into said screw holes is adjusted.

4. The device of claim 3 wherein said means for providing electrical power to said laser device comprises laser wiring that extends from said laser device to a battery.

5. The device of claim 4 wherein said pivot device has a shape and size relative to said bracket and end portion to permit the passage of said laser wiring from said laser device past said pivot device and between said bracket and end portion.

6. The device of claim 5 wherein said bracket includes a cavity therein facing said laser device that is sized to receive said end portion of said laser device to a convenient depth.

7. The device of claim 5 wherein said bracket comprises a trigger guard mounted on a firearm.

8. The device of claim 7 wherein said trigger guard includes channels passing therethrough, and said laser wiring passes from said laser device past said pivot device and through said channels to a portion of said trigger guard that is near to a handle or grip of said firearm.

9. The device of claim 8 further comprising an electrical switch mounted onto said handle or grip and connected to said laser wiring so as to control the current passing through said laser wiring.

10. The device of claim 9 wherein said trigger guard further includes a channel containing battery wiring, said battery wiring being connected at one end to said switch and at the opposite end thereof to a battery so as to control the current passing from said battery wiring to said laser wiring.

11. The device of claim 10 wherein said switch is a momentary switch that is activated by finger pressure.

12. A method of modifying a bracket so as to accommodate the aimable mounting thereon of a laser device that emits a laser beam from an end thereof, comprising providing at least three through holes through said bracket, providing within an end portion of said laser device opposite said end which emits said laser beam a number of screw holes equal in number to, and positioned in a fashion so as to face, said through holes, providing screws that pass through said through holes and rotatably enter said screw holes, and providing means for accommodating a varying depth of entry of each of said screws into said screw holes so as to vary the orientation of said laser device.

13. The method of claim 12 wherein said means for accommodating said varying depth of penetration of each of said screws into said screw holes, so as to vary the orientation of said laser device, comprises providing a pivot device having a half-oval surface facing said bracket and a rim facing said end portion of said laser device.

14. A method of modifying a trigger guard so as to accommodate the aimable mounting thereon of a laser device that emits a laser beam from an end thereof, comprising providing at least three through holes through said trigger guard, providing within an end portion of said laser device opposite said end which emits said laser beam a number of screw holes equal in number to, and positioned in a fashion so as to face, said through holes, providing screws that pass through said through holes and rotatably enter said screw holes, and providing means for accommodating a varying depth of entry of each of said screws into said screw holes so as to vary the orientation of said laser device.

15. The method of claim 14 wherein said means for accommodating said varying depth of penetration of each of said screws into said screw holes, so as to vary the orientation of said laser device, comprises providing a pivot device having a half-oval surface facing a surface of said trigger guard and a rim facing a surface of said end portion of said laser device.

16. The method of claim 15 further comprising adjusting the shape and size of said pivot device so as to permit the passage of laser wiring from said laser device past said pivot device and thence between said trigger guard and said end portion of said laser device.

17. The method of claim 16 further comprising drilling channels through said trigger guard to permit the passage therethrough of said laser wiring.

18. The method of claim 17 wherein the route of said channels through said trigger guard is made to exit therefrom at a point near to a handle or grip of said firearm.

19. The method of claim 18 further comprising providing a switch connected to said laser wiring, and further comprising providing a battery connected to said switch.

20. The method of claim 19 wherein activation of said switch provides connection from said battery to said laser device so as to cause the emission of a laser beam therefrom.

* * * * *